US005438766A

United States Patent [19]

Nakamura

[11] Patent Number: 5,438,766

[45] Date of Patent: Aug. 8, 1995

[54] TUMBLER FOR LOOSENING ENTANGLED CLOTHS

[75] Inventor: Yoshizo Nakamura, Takamatsu, Japan

[73] Assignee: Tokai Co., Ltd., Japan

[21] Appl. No.: 172,810

[22] Filed: Dec. 27, 1993

[51] Int. Cl.[6] ..... F26B 11/04

[52] U.S. Cl. ..... 34/602; 34/595; 68/210; 414/149

[58] Field of Search ..... 68/210; 34/58, 108, 34/129, 135, 328, 545, 602; 134/134; 366/49, 50, 186; 198/404, 586; 414/149, 196; 209/284, 288; 210/374, 407

[56] References Cited

U.S. PATENT DOCUMENTS

| | | | |
|---|---|---|---|
| 4,031,005 | 6/1977 | Der | 209/284 X |
| 4,669,249 | 6/1987 | Aivola et al. | 198/404 X |
| 4,699,564 | 10/1987 | Cetrangolo | 198/404 X |
| 5,027,530 | 7/1991 | Vollmer et al. | 34/236 X |
| 5,228,214 | 7/1993 | Biancalani et al. | 134/129 X |

FOREIGN PATENT DOCUMENTS

| | | |
|---|---|---|
| 0541239 | 2/1992 | European Pat. Off. . |
| 1585890 | 10/1967 | Germany . |
| 2756209 | 12/1977 | Germany . |
| 285384 | 2/1928 | United Kingdom . |
| 1045206 | 6/1965 | United Kingdom . |

*Primary Examiner*—Philip R. Coe
*Attorney, Agent, or Firm*—Lorusso & Loud

[57] ABSTRACT

A rotating drum tumbler for loosening damp, entangled cloths or sheets is disclosed which includes a frame, a cylindrical drum rotatably supported by the frame for rotation about a horizontal axis thereof and having an opening in each of the opposite ends thereof, and drive means for rotating the drum, and which is characterized in that a conveyer is secured within the drum for rotation therewith and operable to discharge the loosened cloths or sheets placed thereon through one of the openings when the drum is maintained in a predetermined position with the conveyer being horizontally positioned.

6 Claims, 5 Drawing Sheets

TUMBLER FOR LOOSENING ENTANGLED CLOTHS

BACKGROUND OF THE INVENTION

This invention relates to a laundry tumbler for loosening damp, entangled cloths or sheets.

In laundry establishments, a large number of cloths and sheets should be treated all together so that the washed, damp materials are unavoidably tightly entangled especially when the washed materials contain large sized cloths and sheets. Thus, the washed, damp materials are generally fed to a rotating drum tumbler for loosening the entangled materials. U.S. Pat. No. 2,960,778 discloses a rotating drum having a door mechanism which can quickly and effectively open and close a door at the side of the drum by a special latching arrangement. Since the cloths and sheets treated in such a tumbler are not completely unraveled and are still damp, it is troublesome to manually discharge the contents from the drum. U.S. Pat. No. 2,960,778 is silent with respect to an unloading mechanism.

SUMMARY OF THE INVENTION

It is, therefore, an object of the present invention to provide a tumbler which permits easy unloading.

Another object of the present invention is to provide a tumbler which is suitable for automatic operation.

In accomplishing the foregoing objects, there is provided in accordance with the present invention a tumbler comprising a frame, a cylindrical drum rotatably supported by said frame for rotation about a horizontal axis thereof and having an opening in each of the opposite ends thereof, drive means for rotating said drum, and conveyer means secured within said drum for rotation therewith and operable to discharge a material placed thereon through one of said openings when said drum is maintained in a predetermined position.

BRIEF DESCRIPTION OF THE DRAWINGS

Other objects, features and advantages of the present invention will become apparent from the detailed description of the preferred embodiment of the invention which follows, when considered in light of the accompanying drawings, in which.

DETAILED DESCRIPTION OF THE PREFERRED EMBODIMENTS OF THE INVENTION

Figure 1:
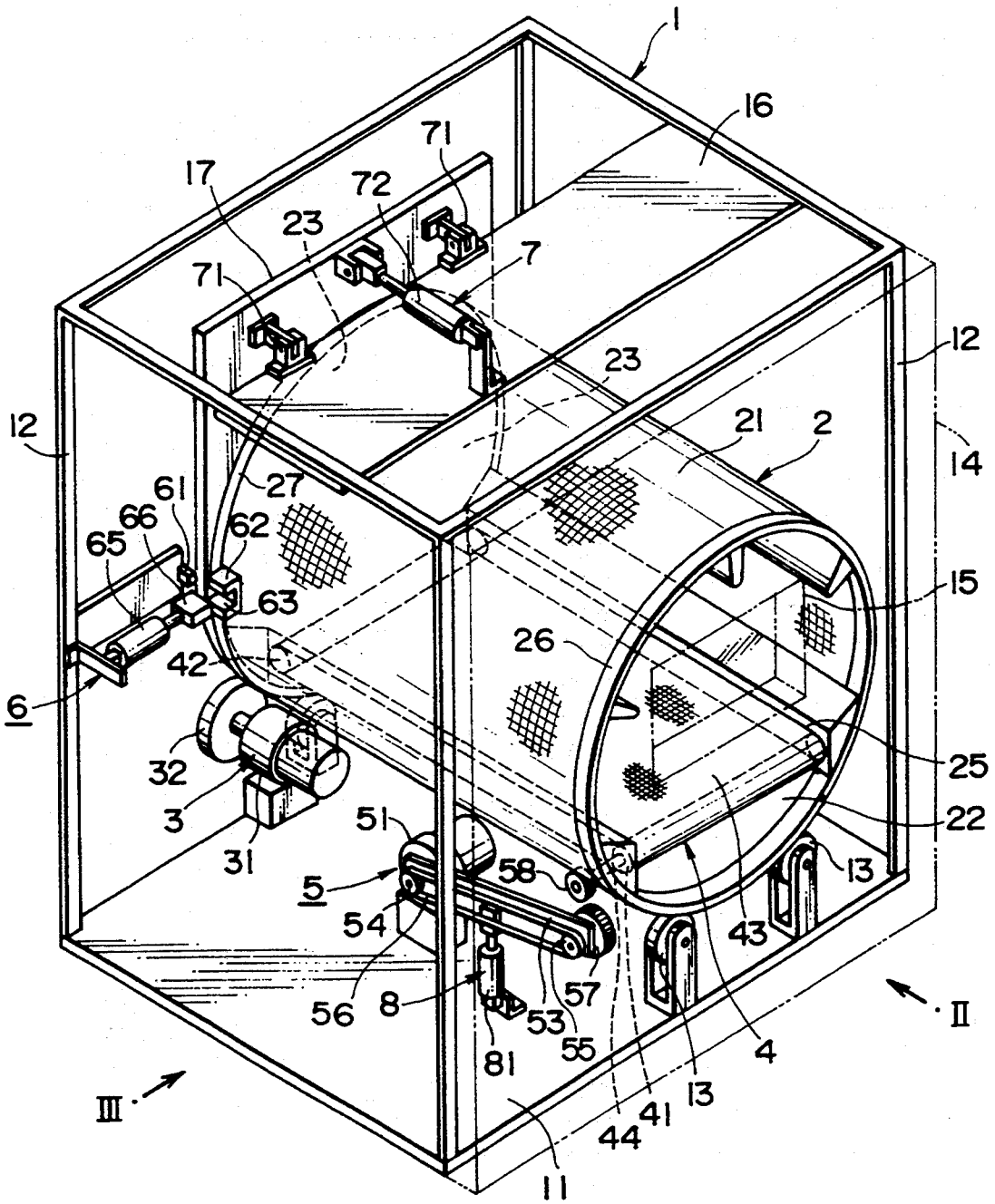
FIG. 1 is a perspective view diagrammatically showing one embodiment of a tumbler according to the present invention.

Referring now to FIGS. 1-3 and 5, the reference numeral 1 denotes a frame including a base plate 11, vertical and horizontal frames 12 and a top plate 16. A cylindrical drum 2 is rotatably mounted on the frame 1 for rotation about a central, horizontal axis thereof. The drum 2 which defines a cloth tumbling chamber therewithin is composed of a pair of front and rear rims 26 and 27 and a tubular body 21 extending between the front and rear rims 26 and 27 and having a multiplicity of perforations. The body 21 in this embodiment is formed of a reinforced metal net. The drum 2 is open at the front end 22 and at the rear end 23.

Two pairs of rollers 13 and 13 are fixed to the frame 1 for rolling and supporting engagement with the front and rear rims 26 and 27 of the drum 2. The drum 2 is rotated by operation of drive means 3 which includes a motor 31 secured to the frame 1, a drive disc 32 fixed to the drive shaft of the motor 31 and maintained in pressure and rolling engagement with the rear rim 27 of the drum 2.

Figure 2:
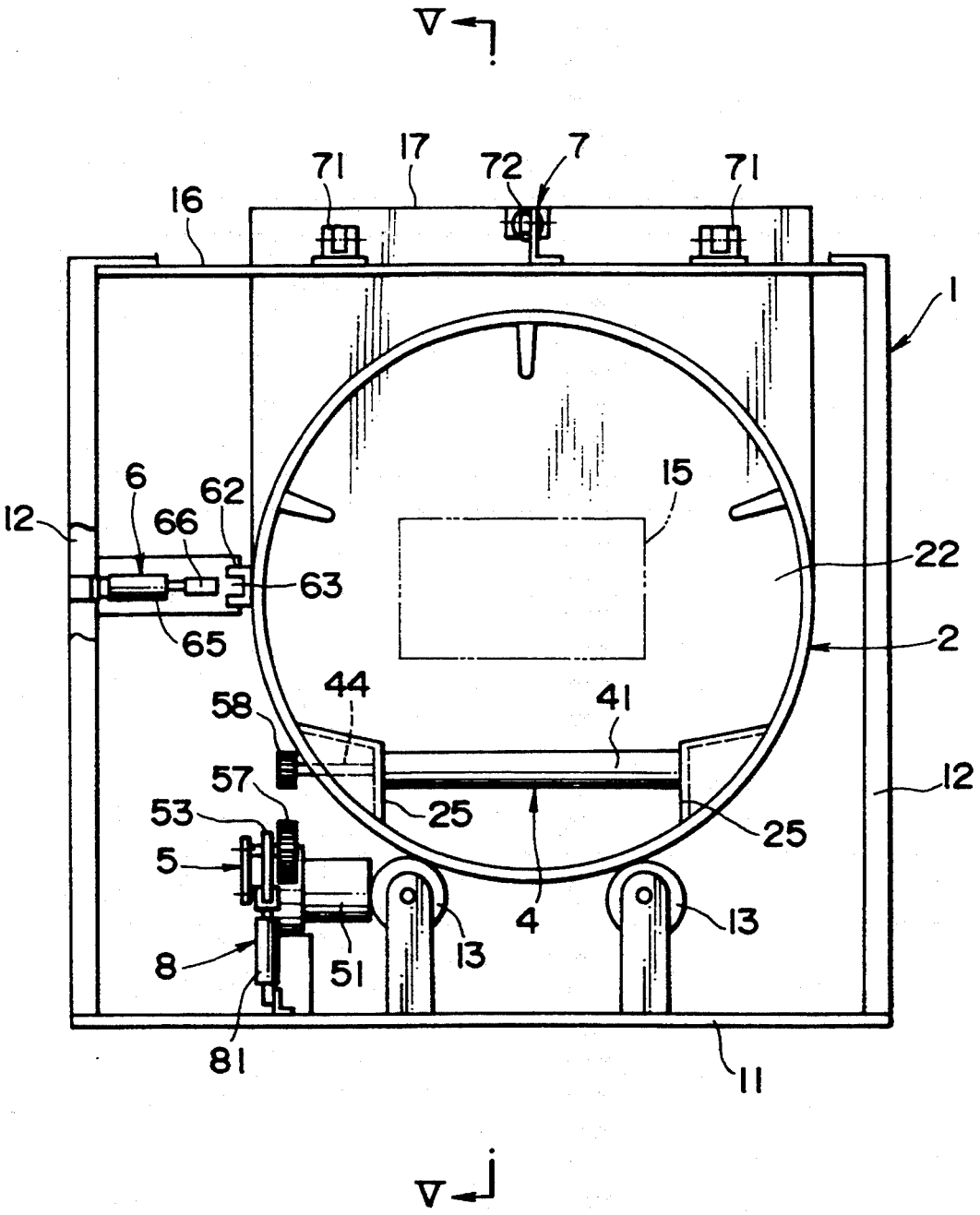
FIG. 2 is an elevational view of FIG. 1 as seen from the direction of the arrow II in FIG. 1.
Figure 3:
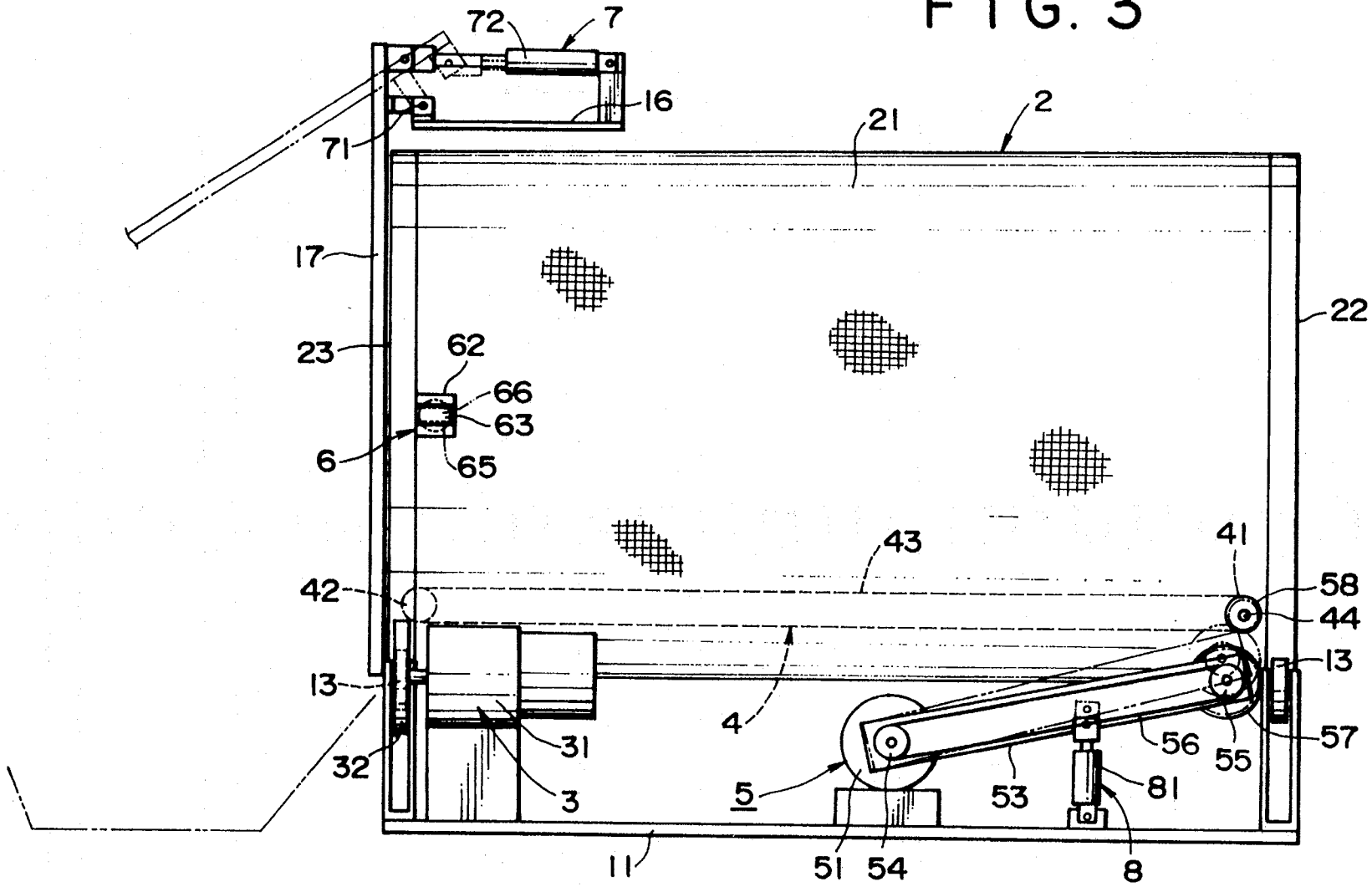
FIG. 3 is a side view of FIG. 1 as seen from the direction of the arrow III in FIG. 1.

Conveyer means 4 is secured within the drum 2 for discharging contents Y (FIG. 5) in the drum 2 through the rear opening 23. The conveyer means 4 includes a pair of front and rear rollers 41 and 42 each rotatably received by a pair of left and right, axially extending supporting plates 25 and 25 fixedly secured to the drum 2. An endless conveyer belt 43 is wound around the rollers 41 and 42 and is caused to run upon driving one of the rollers 41 and 42. The belt 43 in this embodiment is formed of an air permeable wire net. As best seen in FIG. 2, the front roller 41 has a shaft 44 protruded from the body 41 of the drum 2. A driven gear 58 is fixed to an end portion of the shaft 44.

Actuation means 5 is provided on the frame 1 for rotating the front roller 41. The actuation means 5 includes a motor 51 having a drive shaft to which a first pulley 54 is fixed at the tip end thereof. A rockable arm 53 is pivoted on the motor shaft at one end thereof. The other end of the arm 53 is provided with a second pulley 55. The second pulley 55 is fixed to one end of a shaft freely rotatably received by the arm 53, while a drive gear 57 is fixed to the other end of the shaft, so that the second pulley 55 is rotatable together with the drive gear 57. Designated as 56 is an endless belt wound around the first and second pulleys 54 and 55. As a result of the above construction, the driving force of the motor 51 is transmitted to the drive gear 57 by the power transmission mechanism including the first and second pulleys 54 and 55 and the belt 56.

Figure 5:
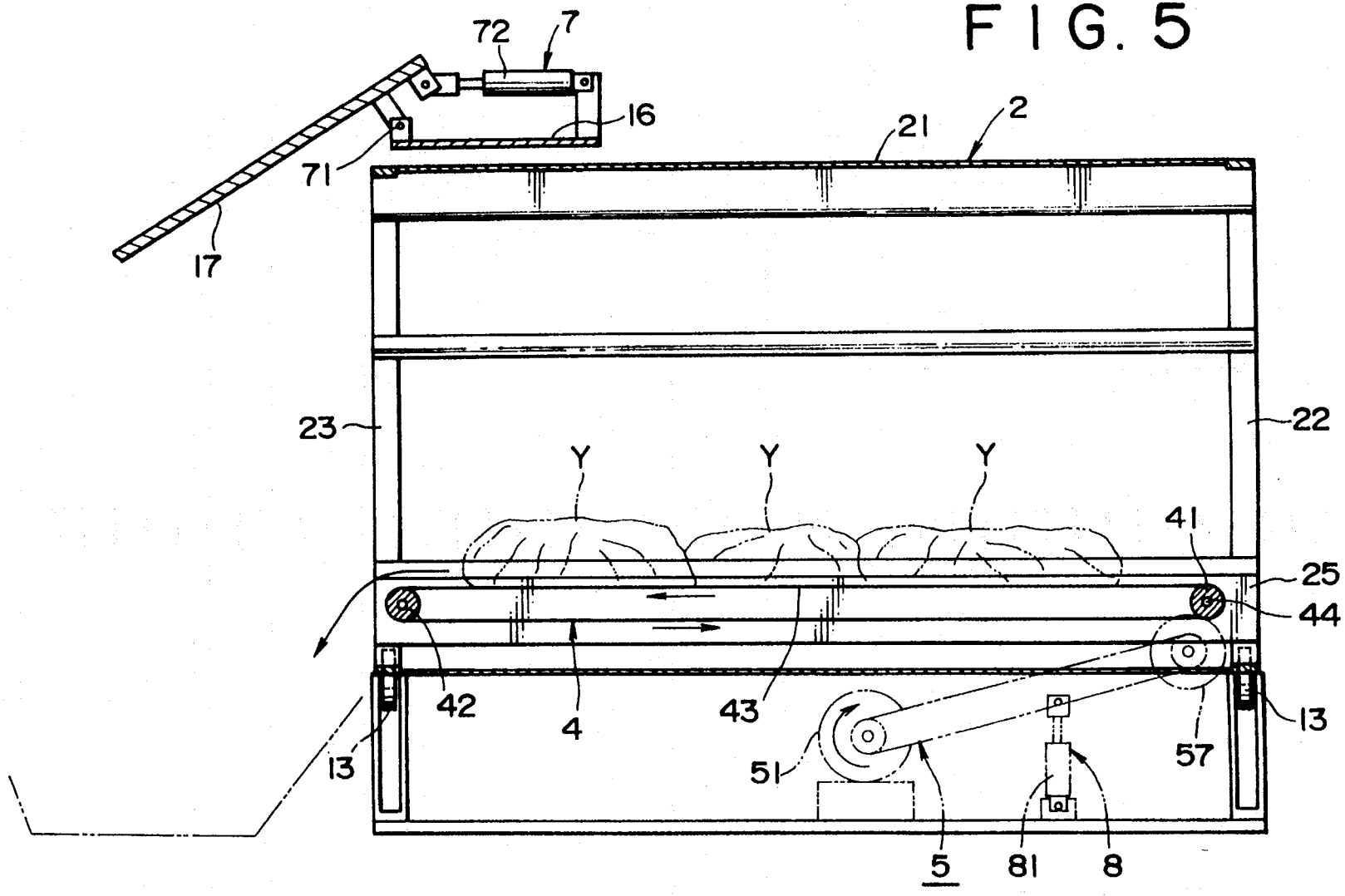
FIG. 5 is a sectional view taken on line V—V in FIG. 2.

Displacing means 8 is provided for rotating the arm 53 between upper and lower positions and, thereby maintaining the drive gear 57 in first and second positions. Thus, when the arm 53 is in the upper position, the drive gear 57 is in the first position where the drive gear 57 engages with the driven gear 58 fixed to the shaft 44 of the front roller 41 provided that the drum 2 is maintained in a predetermined position, as shown in FIG. 5, relative to the frame 1. When the arm 53 is in the lower position, on the other hand, the drive gear 57 is in the second position where the drive gear 57 disengages from the driven gear 58. The displacing means 8 is composed of an air cylinder 81 having an operating rod whose end is supporting engagement with a lower side of the arm 53. The cylinder 81 is operated to extend and retract the operating rod so that the arm 53 is rotated about the motor drive shaft to displace the drive gear 57 between the first position (as shown by the two dotted line in FIG. 3) and the second position (as shown by the solid line in FIG. 3). Thus, when the drive gear 57 is maintained in the first position and is in meshing engagement with the driven gear 58, the driving force of the motor 51 is transmitted through the gears 57 and 58 to the front roller 41 of conveyer 4, so that the upper side of the belt 43 can run in the direction from the front end 22 to the rear end 23.

Figure 4:
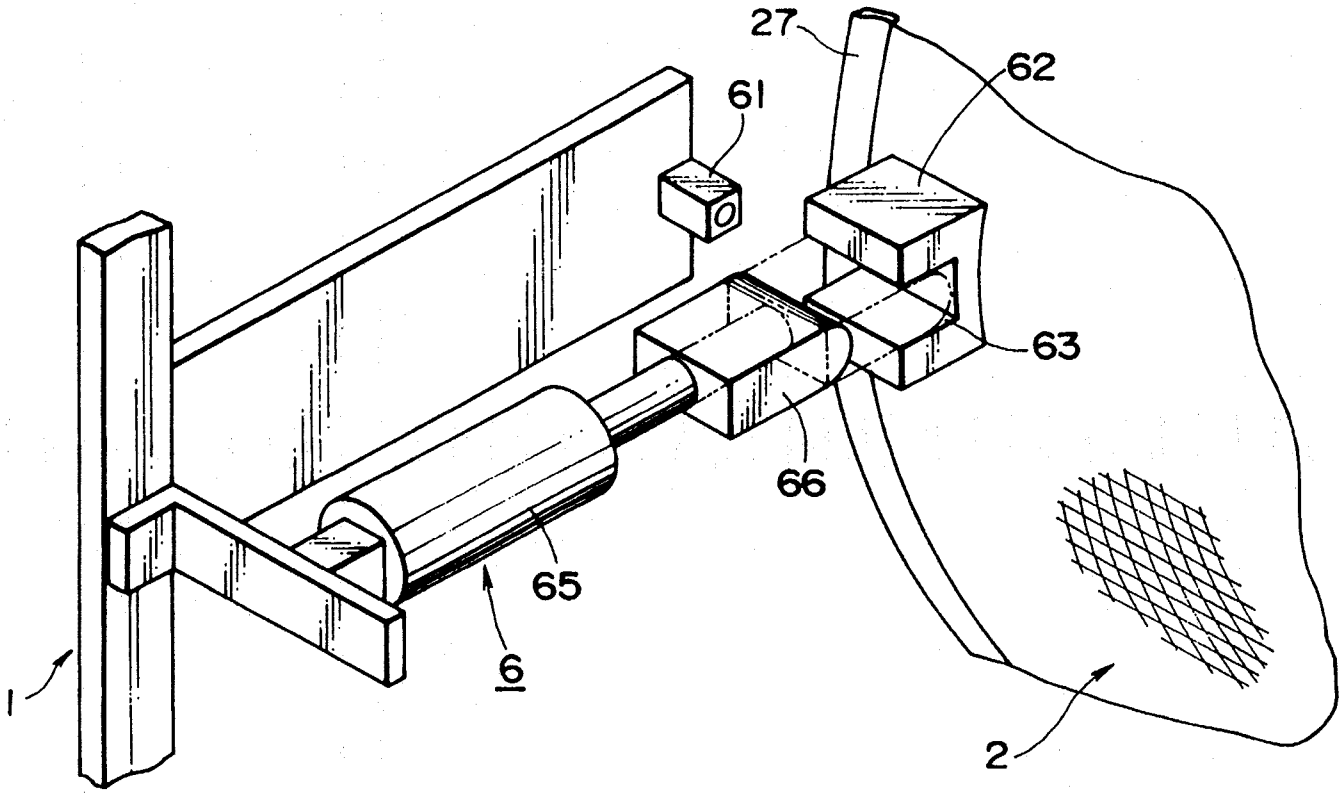
FIG. 4 is an enlarged, partial, perspective view of a drum stopping and locking member of the tumbler of FIG. 1.

Lock means 6 is provided for stopping and maintaining the drum 2 at the predetermined position in which the upper surface of the conveyer belt 43 is in the horizontal position as shown in FIG. 5. One preferred embodiment of the lock means 6 is illustrated in FIG. 4 in which designated as 62 is a latch receiving member fixed on the outer periphery of the drum 2 for rotation therewith. The latch receiving member 62 has a U-shaped form defining a groove 63. An air cylinder 65 is secured to the frame 1. The cylinder 65 has a cylinder rod provided with a latch member 66 at the tip end thereof. By operation of the air cylinder 65, the latch member 66 is moved relative to the drum 2 between an extended position and a retracted position. The air cylinder 65 is positioned so that the latch member 66 is engaged and held by the latch receiving member 62 as shown by the two dotted line in FIG. 4 when the latch member 66 is in the extended position and when the drum 2 is in the predetermined position. In the retracted position, the latch member 66 is disengaged from the latch receiving member 62 as shown by the solid line in FIG. 4.

Referring still to FIG. 4, designated as 61 is a sensor fixed to the frame 1 and adapted to generate a detection signal when the drum 2 is located at the predetermined position. In the illustrated case, the sensor 61 is a photoelectric tube adapted to generate a detection signal when the latch receiving member 62 is located adjacent to the sensor 61, ie. when the drum 2 is positioned in the predetermined position. Any position detector such as a magnetic sensor may be used for the purpose of the present invention. The sensor 61 is electrically connected to a braking mechanism of the motor 31 to stop the rotation of the motor 31.

Referring to FIG. 1, a front cover 14 is secured to the frame 1 to cover the front opening 22 of the drum 2. The cover 14 is provided with an opening 15 for feeding cloths and sheets into the drum 2. A hinged, rear cover 17 is provided to cover the rear opening 23 of the drum 2. The cover plate 17 is connected with a pair of hinges 71 to the top plate 16 of the frame 1. Designated as 7 is an air cylinder fixedly secured on the top plate 16. The cylinder 7 has a cylinder rod pivotally connected to an upper portion of the cover plate 17. As shown in FIG. 5, when the cylinder 7 is actuated to retract the cylinder rod, the rear cover plate 17 is swung to open the rear opening 23 of the drum 2 so that the contents Y on the conveyer 4 can be discharged upon the actuation of the conveyer 4. When the cylinder rod is extended, the cover plate 17 is rotated to close the rear opening 23 as shown in FIG. 1.

If desired, a blower (not shown) may be disposed adjacent to the drum 2 for blowing air or hot air into the tumbling chamber to facilitate the drying of cloths contained therein.

The above-described tumbler device operates as follows. In the initial state where (a) the drive gear 57 is in the second, disengaged position as shown in FIG. 1, (b) the motor 31 is not actuated, (c) the air cylinder 65 is in the retracted position to keep the drum 2 unlocked and (d) the air cylinder 72 is in the extended position to maintain the rear opening 23 in the closed state, damp, entangled cloths and sheets to be treated are fed into the drum through the opening 15. Then a start switch is turned ON. Thus, the drive motor 31 is actuated to start the rotation of the drum 2. This causes the entangled cloths and sheets in the drum 2 to tumble and to be loosened.

After lapse of a predetermined period of time, the motor 31 is OFF. In this case, the sensor 61 is rendered operable and the drum 2 still slowly rotates by inertia. When the latch receiving member 62 is positioned adjacent to the sensor 61, this is detected by the sensor 61 so that a detection signal is generated. The output of the detection signal causes the braking mechanism of the motor 31 to actuate so that the motor 31 stops rotating. As a result, the drum 2 stops rotating at the predetermined position where the conveyer 4 is in the lower, horizontal position. Then, the locking means 6 is operated so that the latch member 66 is engaged by the latch receiving member 62. The cylinder 72 is actuated to rotate the cover plate 17 as shown in FIG. 5. At the same time, the cylinder 81 is actuated to bring the drive gear 57 into meshing engagement with the driven gear 58. Then, the motor 51 is driven to cause the conveyer 4 to run for a period of time sufficient for completely discharge the contents Y in the drum 2. The discharged cloths and sheets are then fed to a next station (not shown) by a conveyer (not shown). After the motor 51 has been stopped, the cylinder 81 is retracted to disengage the gears 57 and 58 from each other, the cylinder 65 is retracted to unlock the drum 2, and the cylinder 72 is extended to close the rear opening 23 with the cover plate 17. The unloaded drum 2 is then charged with the next feed.

The above operation can be performed manually in a remote console or automatically. When a belt conveyer (not shown) for feeding cloths to be treated to the tumbling chamber of the drum 2 is used, the whole operation can be carried out in a fully automatic mode. In an automatic operation, the drive means 3 for rotating the drum 2, the drive means 5 and clutch actuation means 8 for driving the conveyer 4, the locking means 6 for stopping and holding the drum 2 in position, actuating means 7 for opening and closing the cover plate 17 and the like devices are electrically connected to a controller and operated by commands from the controller in a manner well known per se.

If desired, the driving means for driving the conveyer 4 may be disposed within the drum 2. In this case, a first contact electrically connected to the driving means is fixed to the drum, while a second contact electrically connected to a power source is fixed to the frame 1. The first and second contacts are positioned so that they are electrically connected with each other when the drum 2 is positioned in the above-described predetermined position.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

I claim:

1. A tumbler for loosening entangled cloth articles comprising a frame, a cylindrical drum rotatably supported by said frame for rotation about a horizontal axis, said cylindrical drum having an opening in each of first and second opposing ends, a first cover having an access opening and covering said first opposing end except for said access opening, a second cover pivotally mounted for movement between a first position closing said second opposing end and a second, open position, drive means for rotating said drum about said horizontal axis, and conveyer means, secured within said drum for rotation therewith, for discharging the cloth articles placed thereon through one of said openings when said drum is at rest in a predetermined position.

2. A tumbler as claimed in claim 1, further comprising stop means for stopping and holding said drum at said predetermined position.

3. A tumbler as claimed in claim 2, wherein said conveyer means comprises a pair of rollers rotatably mounted on shafts secured within said drum, a conveyer belt wound around said rollers, a driven member fixed to one of said shafts at a position outside of said drum, actuation means secured to said frame and having a driving member moveable between an engaged position where said driving member engages said driven member when said drum is positioned at said predetermined position and a disengaged position where said driving member is disengaged from said driven member, and means for moving said driving member between said engaged and disengaged positions.

4. A tumbler as claimed in claim 2 wherein said stop means comprises:

a latch receiver fixed to said cylindrical drum; and a latch member slidably mounted on said frame for reciprocating motion between a latched position wherein said latch member is engaged by said latch receiver, when said drum is in said predetermined position, and an unlatched position.

5. A tumbler as claimed in claim 4 further comprising a detector mounted on said frame for detecting said predetermined position where said latch receiver is in alignment with said latch member and piston means for driving said latch member between said latched and unlatched positions, said piston means driving said latch member into said latched position responsive to a signal from said detector.

6. A tumbler as claimed in claim 1 wherein said first cover is fixed to said frame and wherein said second cover is pivotally mounted on said frame.

* * * * *